US010774661B2

(12) United States Patent
Sari et al.

(10) Patent No.: US 10,774,661 B2
(45) Date of Patent: Sep. 15, 2020

(54) SHROUD FOR A TURBINE ENGINE

(71) Applicant: General Electric Company, Schenectady, NY (US)

(72) Inventors: Fatih Sari, Kocaeli (TR); Alkim Deniz Senalp, Kocaeli (TR); Sang Yeng Park, West Chester, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 533 days.

(21) Appl. No.: 15/417,813

(22) Filed: Jan. 27, 2017

(65) Prior Publication Data

US 2018/0363482 A1 Dec. 20, 2018

(51) Int. Cl.
*F01D 9/04* (2006.01)
*F01D 25/24* (2006.01)

(52) U.S. Cl.
CPC ..... *F01D 9/04* (2013.01); *F01D 9/041* (2013.01); *F01D 25/246* (2013.01); *F05D 2220/32* (2013.01); *F05D 2240/11* (2013.01); *F05D 2260/36* (2013.01)

(58) Field of Classification Search
None
See application file for complete search history.

(56) References Cited

U.S. PATENT DOCUMENTS

| | | | | |
|---|---|---|---|---|
| 2,510,734 | A | 6/1950 | Bodger | |
| 4,576,551 | A | 3/1986 | Olivier et al. | |
| 4,710,102 | A | 12/1987 | Ortolano | |
| 5,211,540 | A | 5/1993 | Evans | |
| 6,102,655 | A | 8/2000 | Kreitmeier | |
| 6,491,498 | B1 | 12/2002 | Seleski et al. | |
| 7,001,152 | B2 | 2/2006 | Paquet et al. | |
| 8,206,085 | B2 | 6/2012 | Ammann | |
| 8,684,659 | B2 | 4/2014 | Bock | |
| 8,784,041 | B2 | 7/2014 | Durocher et al. | |
| 9,359,907 | B2 | 6/2016 | Tashima et al. | |
| 10,107,122 | B2 * | 10/2018 | Maliniak | F01D 17/162 |
| 2015/0354387 | A1 * | 12/2015 | Maliniak | F01D 17/162 415/1 |

* cited by examiner

*Primary Examiner* — Christopher Verdier
*Assistant Examiner* — Juan G Flores
(74) *Attorney, Agent, or Firm* — Hanley, Flight & Zimmerman, LLC

(57) ABSTRACT

An interlocking shroud assembly for a turbine engine includes at least two shroud elements, each having confronting radial ends that define a split interface with axial fore, aft, and circumferential portions.

27 Claims, 6 Drawing Sheets

SHROUD FOR A TURBINE ENGINE

BACKGROUND OF THE INVENTION

Turbine engines, and particularly gas or combustion turbine engines, are rotary engines that extract energy from a flow of pressurized combusted gases passing through the engine onto a multitude of rotating and stationary turbine airfoils. The stationary turbine airfoils can be supported by shrouds that are interlocked to form a circumferential casing to the turbine.

BRIEF DESCRIPTION OF THE INVENTION

In one aspect, a shroud for a gas turbine engine comprises at least two shroud elements forming a ring and having confronting radial ends that define a split interface with axial fore and aft portions, where the fore portion defines a fore split surface interface forming a positive radial angle relative to a radial line, and the aft portion defines an aft split surface interface forming a negative radial angle relative to the radial line.

In another aspect, a shroud for a gas turbine engine comprises at least two shroud elements forming a ring and having confronting radial ends that define a split interface, where the radial ends have first complementary structures that impede relative radial movement of the at least two shroud elements, second complementary structures that impede relative axial movement of the at least two shroud elements, and third complementary structures that impede relative circumferential movement of the at least two shroud elements.

DESCRIPTION OF EMBODIMENTS OF THE INVENTION

Figure 1:
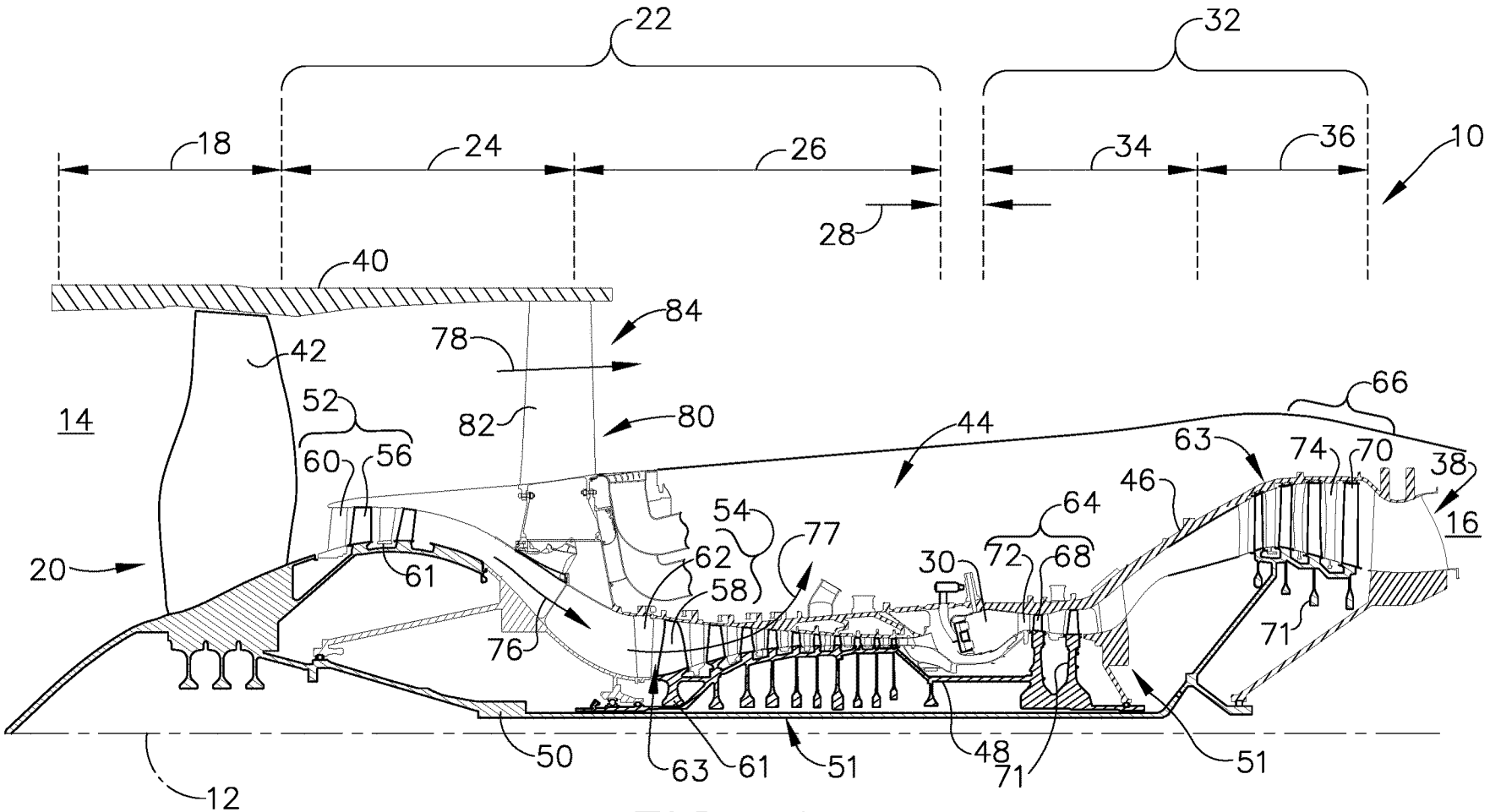
FIG. 1 is a schematic cross-sectional diagram of a turbine engine for an aircraft.

The described embodiments of the present invention are directed to a shroud assembly for stationary airfoils. For purposes of illustration, the present invention will be described with respect to the turbine for an aircraft turbine engine. It will be understood, however, that the invention is not so limited and may have general applicability within an engine, including compressors, as well as in non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component.

Additionally, as used herein, the terms "radial" or "radially" refer to a dimension extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present invention, and do not create limitations, particularly as to the position, orientation, or use of the invention. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a gas turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the centerline 12 while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized air 76 to the HP compressor 26, which further pressurizes the air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
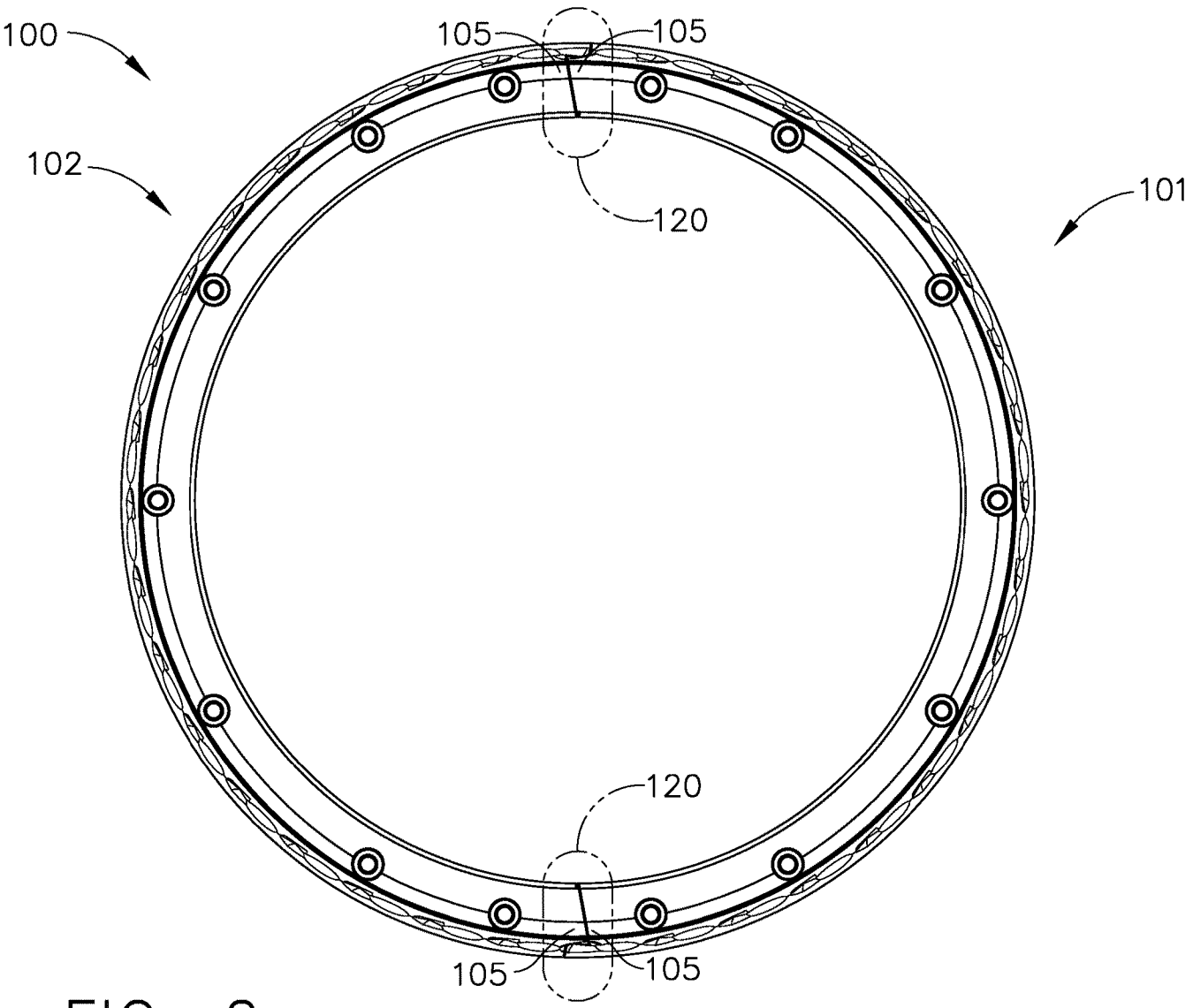
FIG. 2 illustrates a multi-element shroud in the turbine engine of FIG. 1 viewed along the axial centerline of the engine.

FIG. 2 illustrates an axial view of a shroud 100 in the turbine engine of FIG. 1. The shroud 100 comprises at least two shroud elements, illustrated as a first shroud element 101 and second shroud element 102 that together form a ring. The elements 101, 102 each have confronting radial ends 105 defining a split interface 120.

Figure 3:
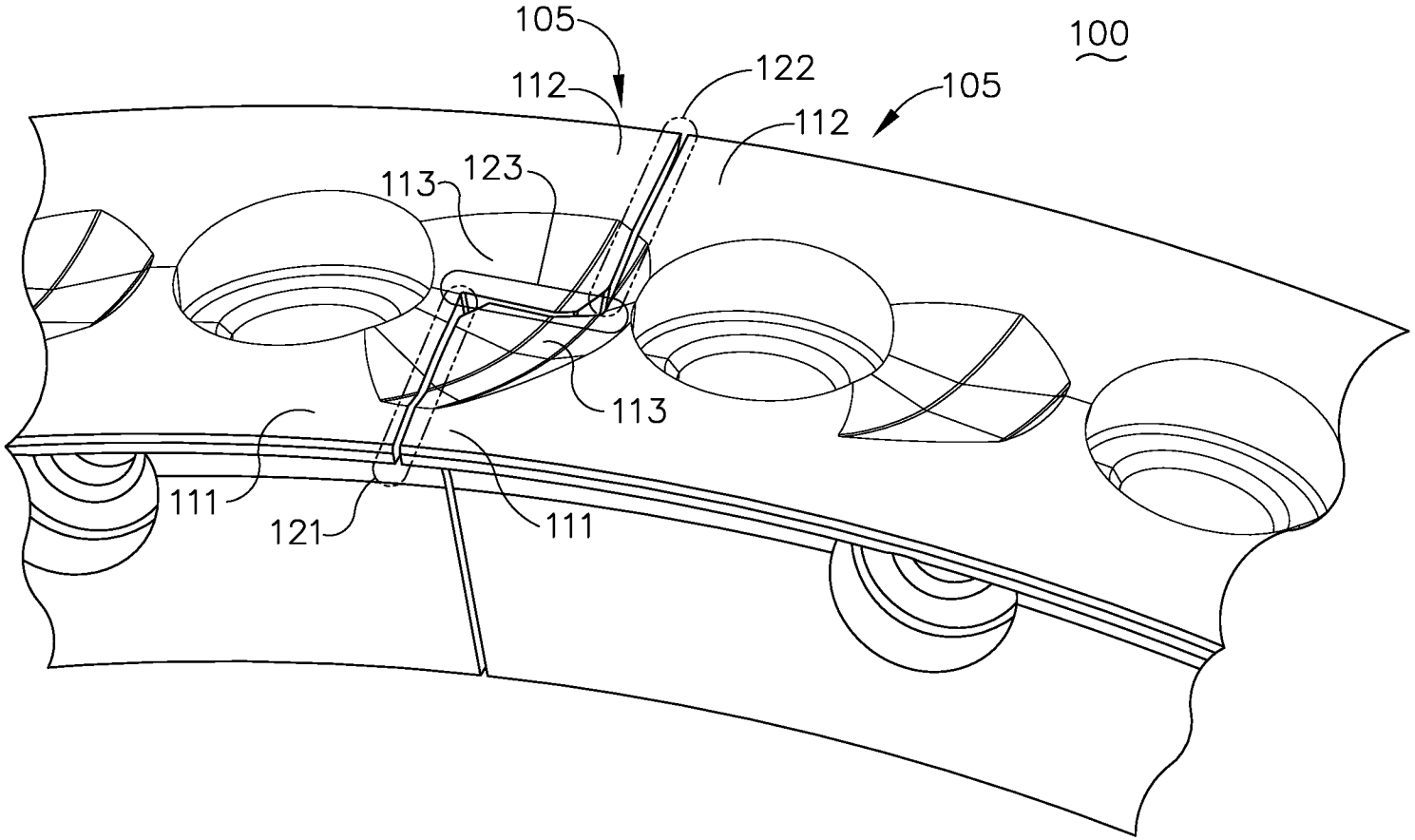
FIG. 3 is a perspective view of a portion of the shroud in FIG. 2 illustrating the interface between two of the shroud elements.

Turning to FIG. 3, each radial end 105 can comprise an axial fore portion 111, an axial aft portion 112, and a circumferential portion 113. Similarly, the split surface interface 120 can comprise a fore split surface interface 121, an aft split surface interface 122, and a circumferential interface 123 as shown.

Figure 4:
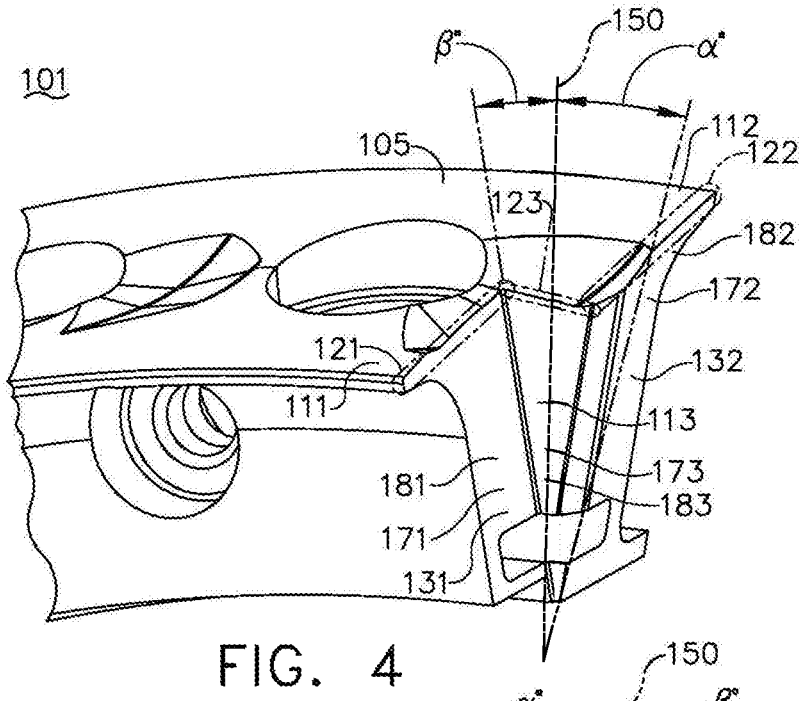
FIG. 4 is a perspective view of a portion of a first shroud element of the shroud in FIG. 2.
Figure 5:
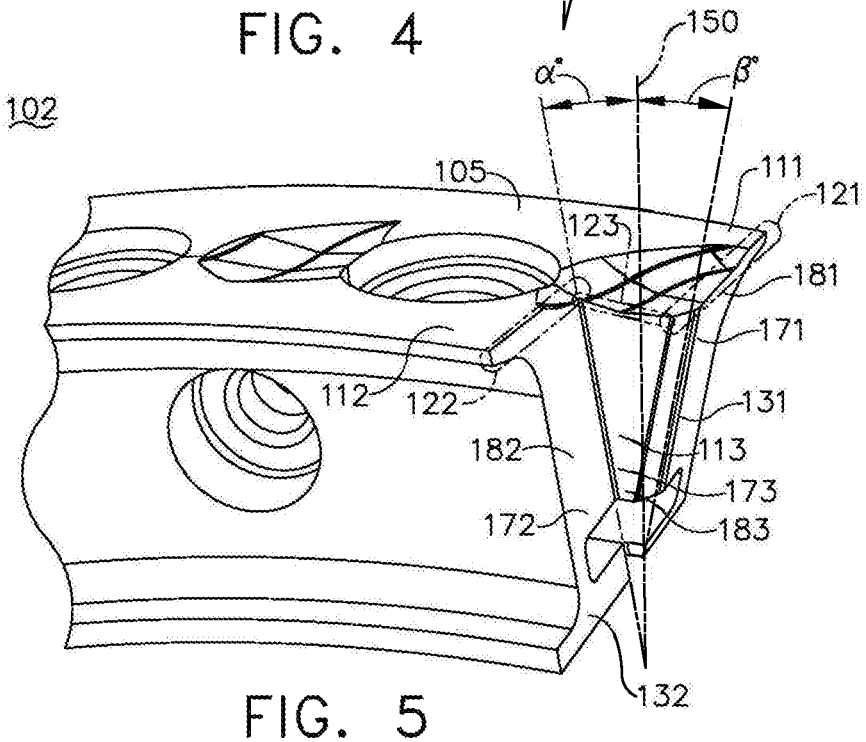
FIG. 5 is a perspective view of a portion of a second shroud element of the shroud in FIG. 2.

The first shroud element 101 is shown in FIG. 4 looking toward the aft direction, while the second shroud element 102 is shown in FIG. 5 looking toward the fore direction, which is opposite the view in FIG. 4. For each element 101, 102, the fore portion 111 can define the fore split surface interface 121, the aft portion 112 can define the aft split surface interface 122, and the circumferential portion 113 can define the circumferential interface 123. Either or both of the fore and aft interfaces 121, 122 may be planar; for example, when viewed along the engine centerline a first plane can be defined by a fore surface plane 131 that forms a positive radial angle $\beta$ relative to a radial line 150, and a second plane can be defined by an aft surface plane 132 that forms a negative radial angle $\alpha$ relative to the radial line 150. Further, the circumferential portion 113 can define the circumferential interface 123 which may form an angle (not shown) relative to the radial line 150.

It is contemplated that the fore portions 111 of the radial ends 105 of the first and second elements 101, 102 comprise first complementary surfaces 171 when the elements 101, 102 are joined together; similarly, the aft portions 112 of the first and second elements 101, 102 comprise second complementary surfaces 172. Either or both of the surfaces 171, 172 may be planar, where the first complementary surface 171 can form a positive radial angle $\beta$ relative to the radial line 150 and the second complementary surface 172 can form a negative radial angle $\alpha$ relative to the radial line 150 as described above.

Figure 6:
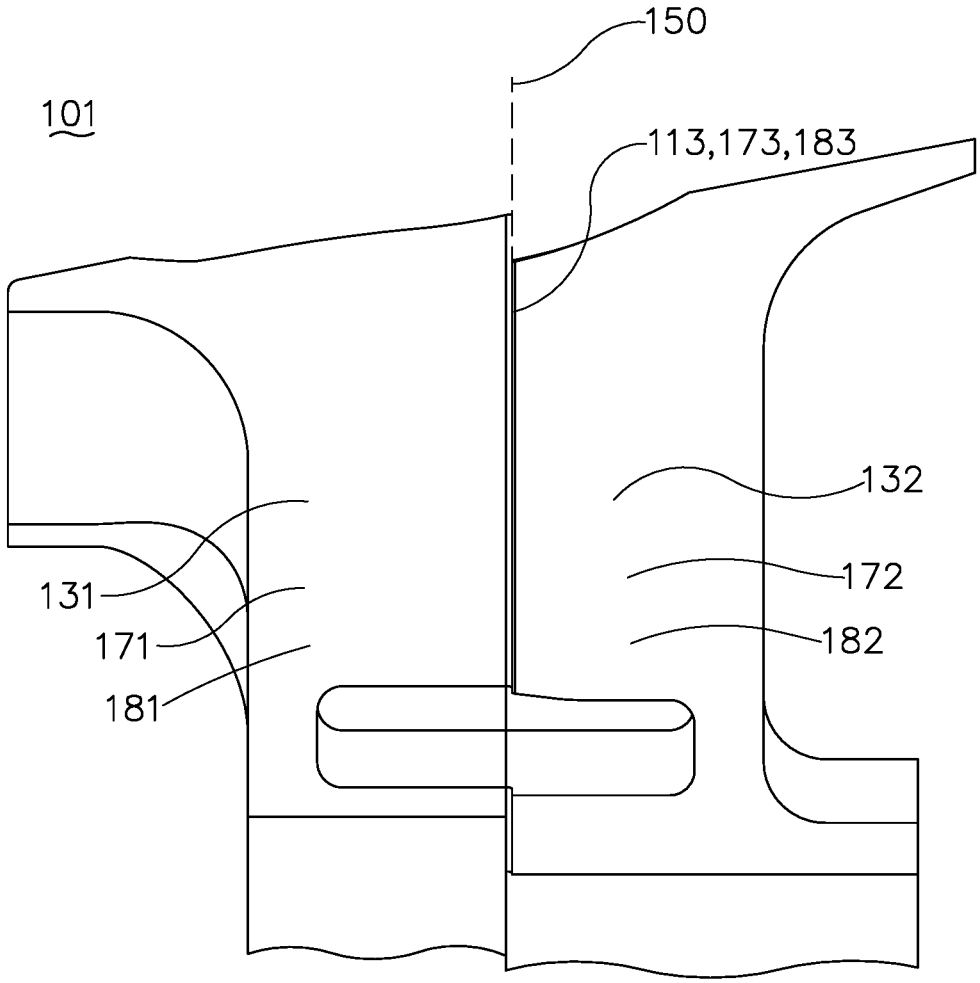
FIG. 6 is a circumferential view of the first shroud element of FIG. 4.

In FIG. 6, a circumferential view of the first shroud element 101 is shown. The circumferential portions 113 can comprise third complementary surfaces 173 which connect the first and second complementary surfaces 171, 172 and which may be planar. While illustrated in alignment with the radial line 150, it is contemplated that the third complementary surfaces 173 of each shroud element 101, 102 may each form an angle relative to the radial line 150 in a manner similar to $\alpha$ and $\beta$ wherein the surface 173 of the first shroud element 101 forms a positive angle, and the surface 173 of the second shroud element 102 forms a negative angle, with respect to the radial line 150.

It can be appreciated that when the first and second elements 101, 102 are joined in a ring to form the shroud 100, the first, second, and third complementary surfaces 171, 172, 173 on the radial ends 105 can be part of first, second, and third complementary structures 181, 182, and 183, respectively (FIGS. 4 and 5). The first structure 181 can form a first angle $\alpha$ relative to the radial line 150, and the second structure 182 can form a second angle $\beta$, which may be opposite the first angle $\alpha$, relative to the radial line 150. Further, the third structure 183 can form a third angle (FIG.

6) which may be a compound angle relative to the radial line 150; for example, the third angle may be formed by a rotation in both the axial and circumferential directions with respect to the radial line 150.

When joined, the first complementary structures 181 can impede relative radial movement, the second complementary structures 182 can impede relative axial movement, and the third complementary structures 183 can impede relative circumferential movement of the shroud elements 101, 102. It is further contemplated that any of the structures 181, 182, 183 can impede relative movement of the shroud elements 101, 102 in the radial, axial, or circumferential direction. For example: in FIG. 4, the second structure 182 can impede relative movement in both radial and circumferential directions due to its angle α with respect to the radial line 150, or the third structure 183 may impede relative movement in both axial and circumferential directions due to its compound third angle with the radial line 150.

Figure 7A:
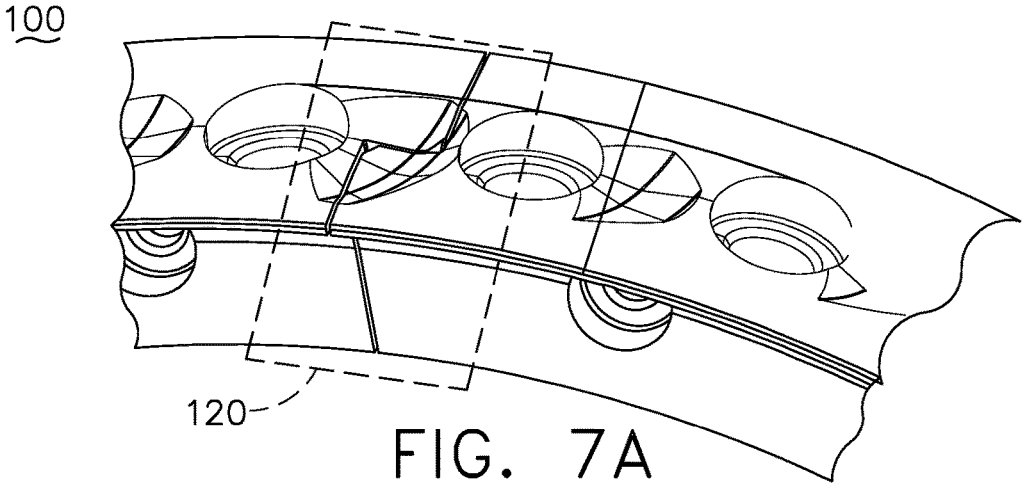
FIGS. 7A-7F show various top views of the shroud in FIG. 2.
Figure 7B:
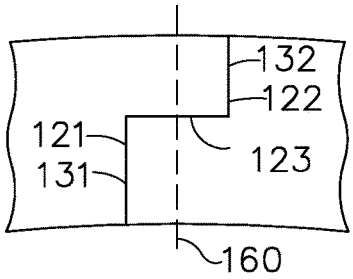
Figure 7C:
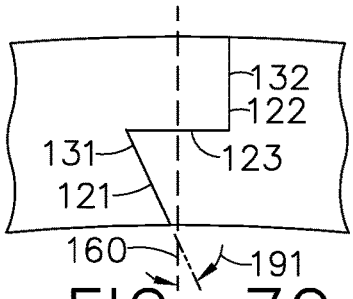
Figure 7D:
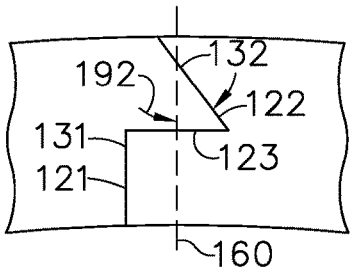
Figure 7E:
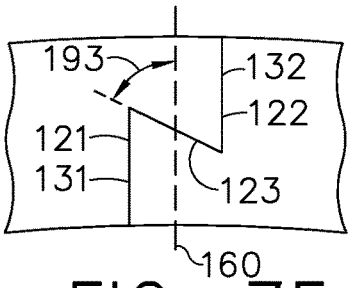
Figure 7F:
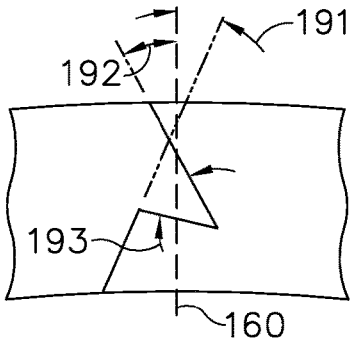

Turning to FIGS. 7A-7F, top views of the shroud 100 illustrate various options for the split surface interface 120 where an axial centerline 160 is shown throughout for reference (FIG. 7A). The shroud 100 has been illustrated thus far with the fore and aft planes 131, 132 parallel to the axial centerline 160 and with the circumferential interface 123 perpendicular to the centerline 160 (FIG. 7B). It is contemplated that the fore plane 131 may form a first axial angle 191 with the centerline 160 (FIG. 7C), and the aft plane 132 may form a second axial angle 192 with the centerline 160 (FIG. 7D). It is also contemplated that the circumferential interface 123 may form a third axial angle 193 with the centerline 160 (FIG. 7E), and further, that any combination of angles 191, 192, 193 may be selected for use in the shroud 100. For example, the first axial angle 191 may be positive while the second axial angle 192 may be negative with respect to the centerline 160 (FIG. 7F). It can be appreciated that any of the first, second, or third axial angles 191, 192, 193 can impede relative movement in both the axial and circumferential directions.

It can be further appreciated that preventing relative motion between the shroud elements 101, 102 can decrease the rate at which the walls of the shroud 100 are worn while the engine is in operation. In addition, the reduced relative motion can allow for the use of less rigid (and less expensive) materials when constructing the shroud 100.

It should be understood that application of the disclosed design is not limited to turbine engines with fan and booster sections, but is applicable to turbojets and turbo engines as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shroud for a turbine engine comprising at least two shroud elements forming a ring defining a circumferential direction, a radial direction, and an axial direction and having confronting radial ends defining a split interface with axial fore and aft portions, the ring including a radially inner surface, the axial fore portion defining a fore surface plane forming a positive radial angle when viewed along a centerline of the turbine engine relative to a radial line extending through an intersection of the radially inner surface and the fore surface plane, and the axial aft portion defining an aft surface plane forming a negative radial angle when viewed along the centerline of the turbine engine relative to the radial line.

2. The shroud of claim 1 wherein the axial fore portion comprises first complementary surfaces.

3. The shroud of claim 2 wherein the axial aft portion comprises second complementary surfaces.

4. The shroud of claim 1, wherein at least one of the fore and aft surface planes is at an oblique angle to an axial centerline for the ring.

5. The shroud of claim 4 wherein both of the fore and aft surface planes are at an angle to the axial centerline to define first and second axial angles.

6. The shroud of claim 5 wherein one of the first and second axial angles is positive relative to the axial centerline and the other of the first and second axial angles is negative relative to the axial centerline.

7. The shroud of claim 6 wherein the split interface further comprises a circumferential portion connecting the axial fore and aft portions.

8. The shroud of claim 7 wherein the circumferential portion defines a circumferential interface between the confronting radial ends.

9. The shroud of claim 8 wherein the circumferential interface forms an angle relative to the radial line.

10. The shroud of claim 1 wherein the shroud comprises two shroud elements forming the ring.

11. A shroud for a gas turbine engine comprising at least two shroud elements forming a ring defining a circumferential direction, a radial direction, and an axial direction, with the ring having confronting radial ends including first complementary structures extending partially in the circumferential direction thereby impeding relative circumferential movement of the at least two shroud elements, second complementary structures extending partially in the circumferential direction thereby impeding relative circumferential movement of the at least two shroud elements, and third complementary structures impeding relative axial movement of the at least two shroud elements.

12. The shroud of claim 11 wherein the first complementary structures comprise first complementary surfaces on the radial ends that form a first angle relative to a radial line of the ring, with the radial line intersecting the ring between the first complementary structures and the second complementary structures.

13. The shroud of claim 12 wherein the second complementary structures comprise second complementary surfaces on the radial ends that form a second angle relative to the radial line of the ring, with the second angle being on a radially opposite side of the radial line.

14. The shroud of claim 13 wherein the third complementary structures comprise third complementary surfaces on the radial ends that form a third angle relative to the radial line of the ring, with the third angle forming a compound angle relative to the radial line.

15. The shroud of claim 14 wherein the third complementary surfaces connect the first and second complementary surfaces.

16. The shroud of claim 15 wherein the first and second angles have an opposite sign relative to the radial line.

17. The shroud of claim 16 wherein the shroud comprises two shroud elements forming the ring.

18. A circumferential structure that surrounds a rotor and comprises at least two elements forming a ring defining a circumferential direction, a radial direction, and an axial direction and having confronting radial ends defining a split interface with axial fore and aft portions, the ring including a radially inner surface, the axial fore portion defining a fore surface plane forming a positive radial angle when viewed along a centerline of the circumferential structure relative to a radial line extending through an intersection of the radially inner surface and the fore surface plane, and the axial aft portion defining an aft surface plane forming a negative radial angle when viewed along the centerline of the circumferential structure relative to the radial line.

19. The circumferential structure of claim 18 wherein the axial fore portion comprises first complementary surfaces.

20. The circumferential structure of claim 19 wherein the axial aft portion comprises second complementary surfaces.

21. The circumferential structure of claim 18, wherein at least one of the fore and aft surface planes is at an angle to an axial centerline for the circumferential structure.

22. The circumferential structure of claim 21 wherein both of the fore and aft surface planes are at an angle to the axial centerline to define first and second axial angles.

23. The circumferential structure of claim 22 wherein one of the first and second axial angles is positive relative to the axial centerline and the other of the first and second axial angles is negative relative to the axial centerline.

24. The circumferential structure of claim 23 wherein the split interface further comprises a circumferential portion connecting the axial fore and aft portions.

25. The circumferential structure of claim 24 wherein the circumferential portion defines a circumferential interface between the confronting radial ends.

26. The circumferential structure of claim 25 wherein the circumferential interface forms an angle relative to the radial line.

27. The circumferential structure of claim 18 wherein the circumferential structure comprises two elements that join to form the circumferential structure.

* * * * *